US005791326A

United States Patent [19]

Brown et al.

[11] Patent Number: 5,791,326

[45] Date of Patent: Aug. 11, 1998

[54] PROJECTILE LAUNCHER WITH SLIDABLE LAUNCH TUBE

[75] Inventors: Robert L. Brown; Michael A. Moore; Hampton R. Woodhouse, all of Cincinnati, Ohio

[73] Assignee: Hasbro, Inc., Pawtucket, R.I.

[21] Appl. No.: 788,904

[22] Filed: Jan. 23, 1997

[51] Int. Cl.[6] ..... F41B 11/14

[52] U.S. Cl. ..... 124/66

[58] Field of Search ..... 124/56, 66, 67, 124/83

[56] References Cited

U.S. PATENT DOCUMENTS

| | | | |
|---|---|---|---|
| 1,248,507 | 12/1917 | Lefever . | |
| 1,633,031 | 6/1927 | Lefever . | |
| 2,449,187 | 9/1948 | Walters . | |
| 2,683,330 | 7/1954 | Taylor . | |
| 2,831,475 | 4/1958 | Daniel . | |
| 3,271,033 | 9/1966 | Parker . | |
| 4,583,958 | 4/1986 | Matsuda | 446/308 |
| 4,689,033 | 8/1987 | Droller et al. | 446/183 |
| 4,870,945 | 10/1989 | Hutchison | 124/68 |
| 5,186,156 | 2/1993 | Clayton | 124/59 |
| 5,205,271 | 4/1993 | Casas Salva | 124/66 |
| 5,242,323 | 9/1993 | Rappaport | 446/180 |
| 5,267,549 | 12/1993 | Webber | 124/65 |
| 5,323,755 | 6/1994 | Hsieh | 124/66 |
| 5,333,881 | 8/1994 | Cugliari | 124/64 |
| 5,343,850 | 9/1994 | Steer . | |
| 5,377,655 | 1/1995 | Arad | 124/65 |
| 5,535,729 | 7/1996 | Griffin et al. | 124/66 |

FOREIGN PATENT DOCUMENTS 483899 1/1938 United Kingdom .

OTHER PUBLICATIONS

Nerf® Eagle Eye™ Information, 3 pages.

*Primary Examiner*—John A. Ricci

*Attorney, Agent, or Firm*—Marshall, O'Toole, Gerstein, Murray & Borun

[57] ABSTRACT

There is disclosed a toy projectile launcher having a slidable launch tube capable of sliding in a cylinder to compress gas and receiving that compressed gas to launch a projectile. The toy projectile launcher may also include focusable lights that improve accuracy up to a certain distance.

25 Claims, 4 Drawing Sheets

PROJECTILE LAUNCHER WITH SLIDABLE LAUNCH TUBE

FIELD AND BACKGROUND OF THE INVENTION

This invention relates generally to toy projectile launchers and particularly to air powered toy projectile launchers using a sliding launch tube to compress air in a cylinder and release the compressed air from the launch tube to launch a projectile without the use of a separate piston.

Toy projectile launchers having a fixed launch tube are known in the art. For example, U.S. Pat. No. 5,242,323 discloses an air powered toy bow and arrow set having a fixed, non-movable launch tube. To generate compressed air for firing a projectile from the launch tube, there is a separate spring-loaded piston slidably disposed inside a cylinder. Other projectile launchers use various piston and cylinder arrangements to launch projectiles from one or more fixed launch tubes.

One known toy projectile launcher includes a flexible and sliding launch tube that curls when a trigger is pulled because the launch tube is placed under tension by a sliding trigger-operated mechanism. Consequently, the launch tube slides somewhat, but is not capable of generating pressure. Instead, a cockable piston, disposed in a cylinder separate from the launch tube, is used to generate the pressure required to launch a projectile.

Also, the use of light bulbs in toy projectile launchers is known. One commercial toy projectile launcher uses a two stage trigger assembly to activate the light bulbs and then fire a projectile. This mechanism also includes a lens which may be adjusted to change the focal point of radiated light.

Thus, it is desirable to have a toy projectile launcher having a slidable launch tube capable of compressing air in a cylinder, instead of a separate piston, to generate the pressure needed to propel a projectile. It is further desirable for this toy projectile launcher to have an adjustable lens for focusing light on a target point.

SUMMARY OF THE INVENTION

The present invention provides novel play value in a toy projectile launcher having a slidable launch tube capable of being cocked and released to generate the pressure required to propel a projectile making unnecessary a separate piston for this purpose. The present invention also provides play value to a toy projectile launcher by having an adjustable lens which can be used to focus a trigger-activated light bulb on a target point.

One embodiment of a toy projectile launcher in accordance with the present invention includes: a housing; a cylinder fixed to the housing and defining an inner bore; a projectile launch tube slidably disposed in the cylinder for movement from a cocked position to an uncocked position to compress gas in the cylinder, and including a projectile holder in fluid communication with the cylinder to releasably mount a projectile to be launched; a seal fixed to the projectile launch tube and in sealing engagement with the cylinder inner bore; a sear for releasably engaging the projectile launch tube in the cocked position; biasing means for returning the projectile launch tube to the uncocked position; and a trigger for engaging the sear to release the projectile launch tube from the cocked position and emit compressed gas to the projectile holder.

The projectile holder may define a chamber for receiving a projectile therein, and the projectile holder may be adapted to receive a projectile made of soft material. The toy projectile launcher may further include a cocking handle fixed to the projectile launch tube.

The toy projectile launch tube's cocked position may be a forward position and the uncocked position may be a rearward position.

The projectile launch tube may have an integrally formed sear engagement rib. Further, the sear may comprise a trigger actuated bearing surface, a retention tab for releasably engaging the sear engagement rib, and a spring for biasing the retention tab into releasable engagement with the projectile launch tube sear engagement rib.

The trigger may have a ramp for slidably engaging the sear's bearing surface to move the sear out of engagement with the sear engagement rib on the launch tube when the trigger is pulled. The cylinder may have an aperture through which the sear extends to engage the launch tube engagement rib in the cocked position.

The toy projectile launcher may further include: a power source; a light bulb in electrical communication with the power source; a fixed contact attached to the housing and in electrical communication with the light and the power source; and a movable contact fixed to the trigger and in electrical communication with the power source, and movable from an open position to a closed position in electrical communication with the fixed contact to define a circuit between the power source and the light bulb and cause the light bulb to illuminate.

The toy projectile launcher may further include an adjuster lens joined to the housing such that light from the light bulb radiates through the adjuster lens when the movable contact is in the closed position. The toy projectile launcher may further include a pair of light bulbs disposed in the housing and in electrical communication with the power source and a pair of openings in the housing, such that each light bulb radiates light through at least one of the openings when the movable contact is in the closed position.

The toy projectile launcher may include a movable contact in the open position being spaced apart from the fixed contact, such that the movable contact moves to the closed position before the trigger engages the sear to release the projectile launch tube from the cocked position.

DETAILED DESCRIPTION OF THE DRAWINGS

Figure 1:
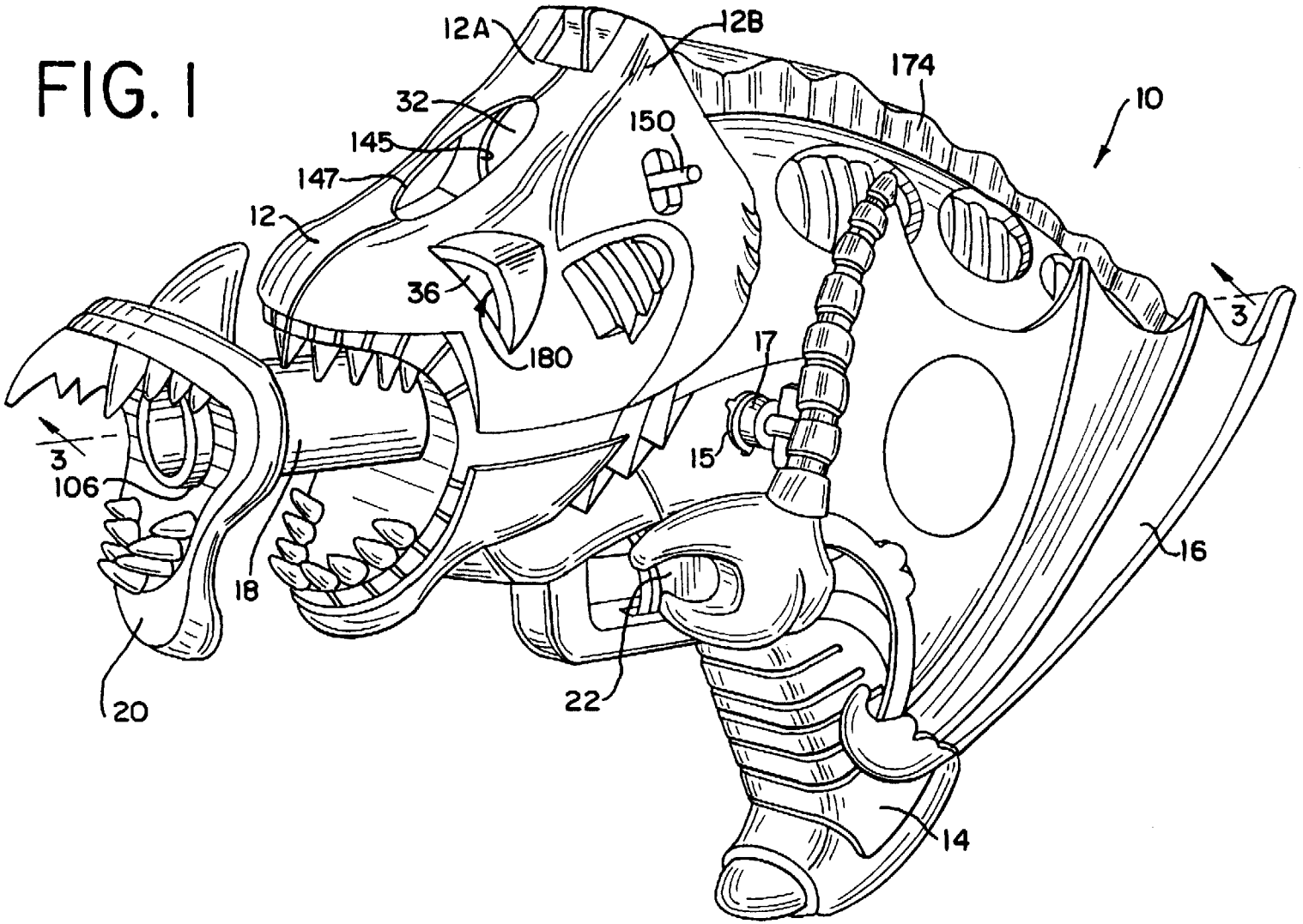
FIG. 1 is a perspective view of a toy projectile launcher in accordance with the present invention in an uncocked position.

To the extent practical, the same reference numerals will be used with the same element in each of the figures described herein. FIG. 1 illustrates a toy projectile launcher 10 in accordance with the present invention. The projectile launcher 10 generally includes a housing 12 with a handle 14, a pair of detachable wings 16 each having a pair of securing posts 17, a projectile launch tube 18, a cocking handle 20, and a trigger assembly 22.

The housing 12 is a hollow shell, preferably formed as a separate right and left half, 12A and 12B, respectively, and manufactured of plastic. The right and left half 12A, 12B can be screwed, sonic welded, or secured together by any other means to form the housing 12. The housing 12 defines openings 15 into which the securing posts 17 are snapped to secure the detachable wings 16 to the housing 12. The housing 12, the detachable wings 16 and the cocking handle 20 are preferably shaped in the form of a stylized fictional creature, as illustrated, but they can be of any shape or style as play criteria require.

Figure 2:
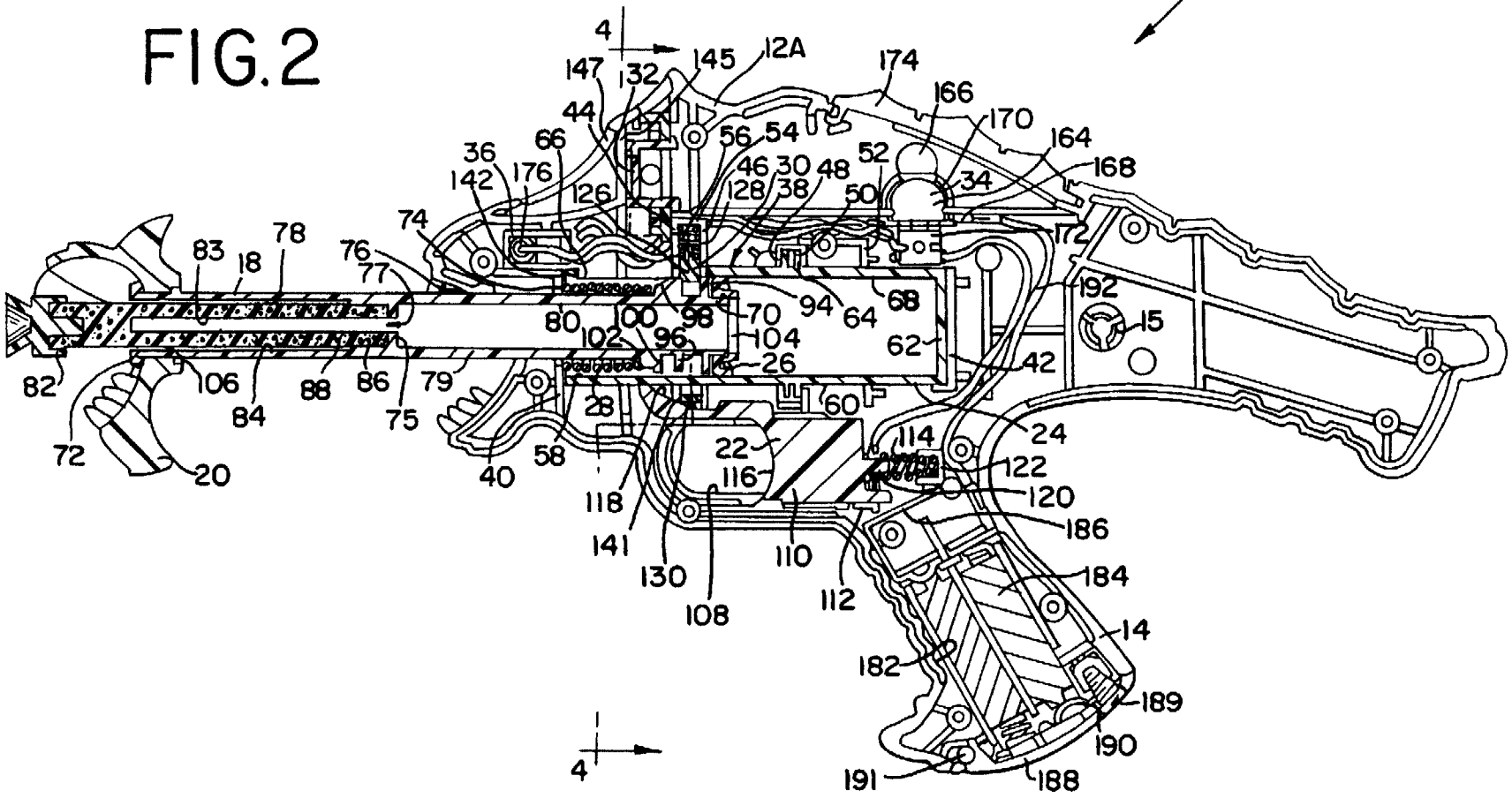
FIG. 2 is a cross-sectional side view of the toy projectile launcher of FIG. 1 in a forward cocked position.
Figure 3:
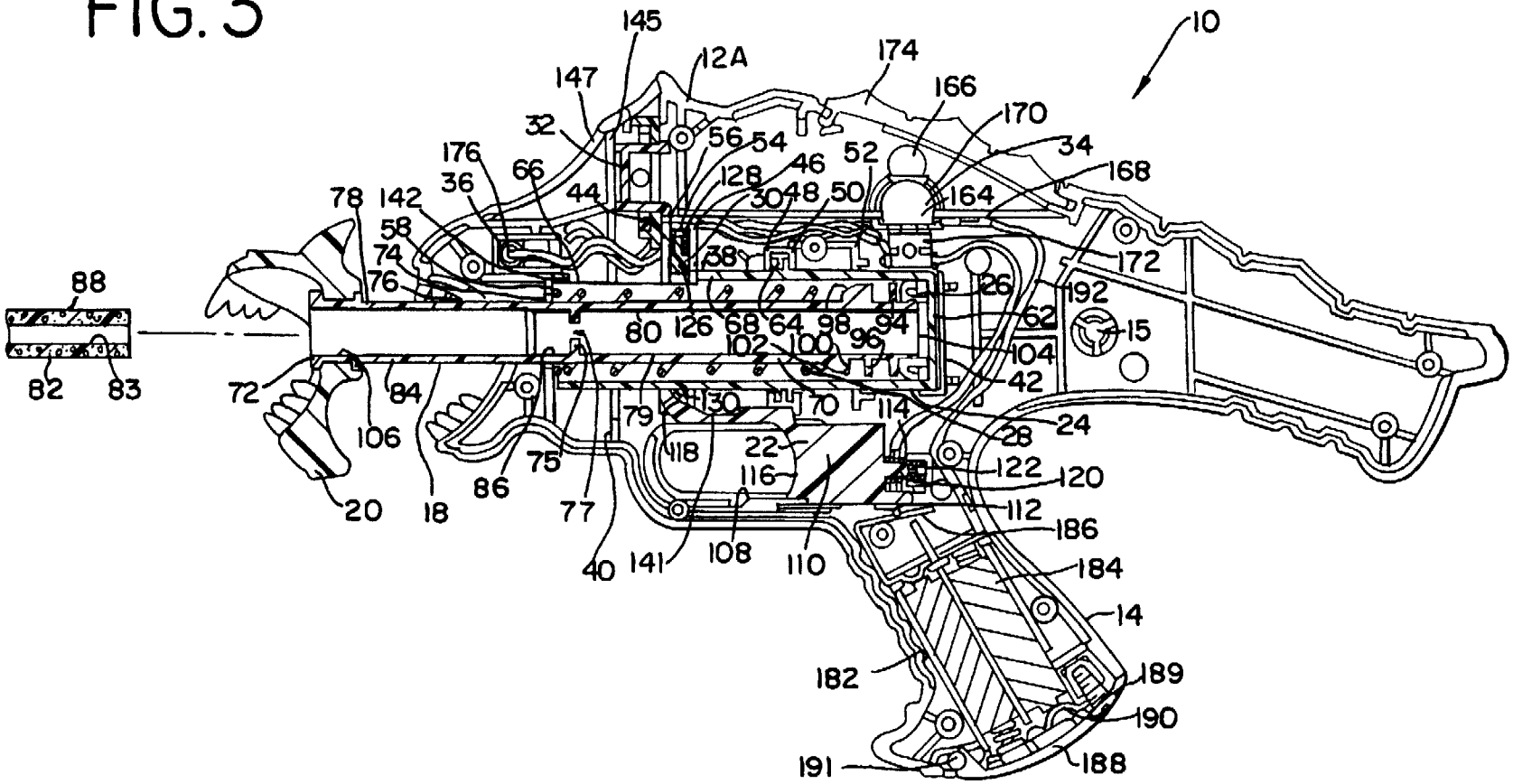
FIG. 3 is a cross-sectional side view of the toy projectile launcher launching a dart taken along line 3—3 in FIG. 1.
Figure 4:
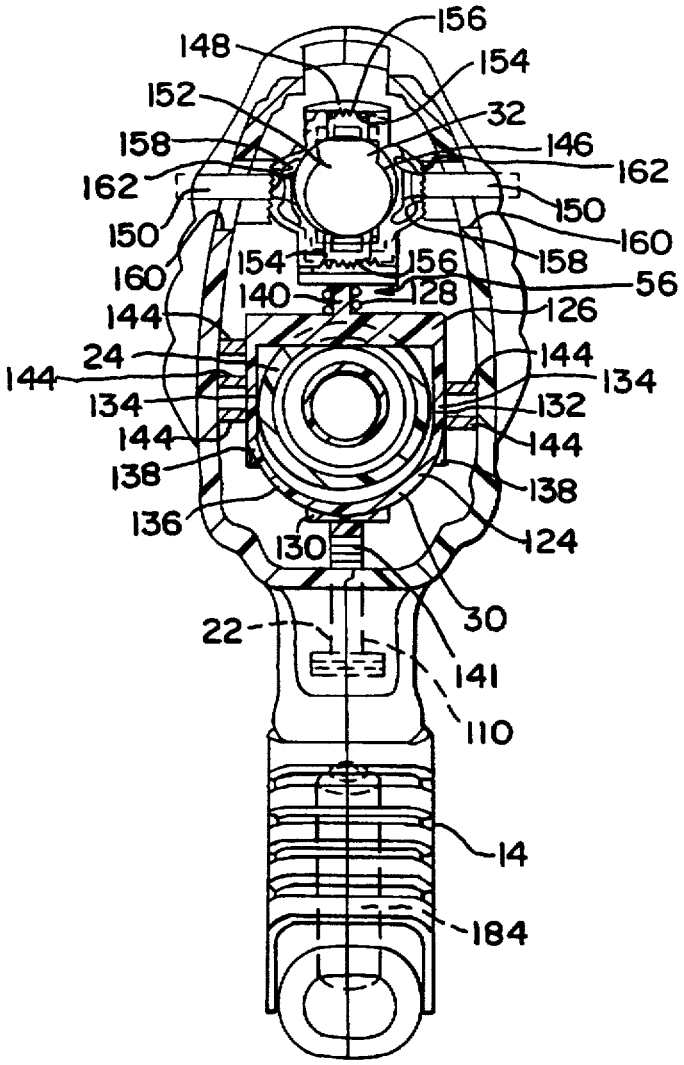
FIG. 4 is a cross-sectional view taken along line 4—4 in FIG. 2.

Referring now to FIGS. 2–4, the toy projectile launcher 10 is illustrated in greater detail. The toy projectile launcher 10 further includes a cylinder 24, a resilient seal 26 (preferably made of santoprene), a biasing means in the form of a return spring 28, and a sear 30. The housing 12 defines a number of compartments and slots which are symmetrical on the right and left halves 12A, 12B, except as noted below. In particular, the housing 12 defines a cylinder compartment 38. The cylinder compartment 38 is defined by a return spring compression wall 40 on one end, a cylinder retention wall 42 on another end, and in between, a first retention rib 44, a second retention rib 46, a third retention rib 48, a fourth retention rib 50, and a fifth retention rib 52. The return spring compression wall 40, the cylinder retention wall 42, and all of the retention ribs 44–52 are integrally formed with the housing 12. A cylinder key (not depicted), also integrally formed with the housing 12, spans between and is connected to the third and fourth retention ribs 48, 50 on the right half 12A of the housing 12. A sear spring compression wall 54 is integrally formed with the housing 12 and spans between and connects the tops of the first and second retention ribs 44, 46 to form a sear spring chamber 56.

The cylinder 24 is disposed in the cylinder compartment 38. The cylinder 24 is preferably manufactured of plastic and includes an open end 58, an annular sidewall 60, a back wall 62, and an exterior retention ring 64 which defines a key notch (not depicted). The cylinder 24 further defines a sear receiving aperture 66. The sear receiving aperture 66 is cut into a portion of the annular sidewall 60 near the open end 58. Also, the annular sidewall 60 defines an inner bore 68. The cylinder 24 is oriented in the cylinder compartment 38 so that the back wall 62 abuts the cylinder retention wall 42, and the open end 58 abuts the return spring compression wall 40. Furthermore, the exterior retention ring 64 is disposed between the third and fourth retention ribs 48, 50. The interaction of the exterior retention ring 64 and the retention ribs 48, 50 keeps the cylinder 24 from moving axially when the projectile launcher 10 is in use. The key notch (not depicted) of the retention ring 64 engages the cylinder key (not depicted) of the housing 12 and keeps the cylinder 24 from rotating radially during use. The cylinder key and the key notch also ensure that the cylinder 24 is correctly installed since the key only fits into the cylinder 24 one way.

The projectile launch tube 18 has a cylinder end 70 and a projectile end 72. The cylinder end 70 is disposed in the inner bore 68 of the cylinder 24 and can be slid freely back and forth within the bore 68. The projectile launch tube 18 extends forward from the cylinder end 70 through an opening 74 in the return spring compression wall 40 and through an opening 76 in the housing 12. The projectile end 72 is disposed forward of the housing 12. The projectile launch tube 18 also includes a projectile holder 78, a separation wall 75 which defines an opening 77 and a conduit 79 which defines an inner passage 80. The separation wall 75 separates the projectile holder 78 from the conduit 79. The projectile holder 78 is sized and shaped such that it will receive therein a plastic tipped foam dart 82 having a shaft 88, but other projectile holder bore shapes and sizes can be used to accommodate various sizes, shapes, and materials of projectiles. The shaft 88 of the dart 82 defines an inner chamber 83. The projectile holder 78 is formed to define a dart support chamber 84 and a dart fit chamber 86. The diameter of the dart fit chamber 86 is less than the diameter of the support chamber 84, and is approximately equal to the diameter of the dart shaft 88, such that when a dart 82 is inserted into the projectile holder 78, an interference fit is created between the shaft 88 and the fit chamber 86. The separation wall 75 keeps the dart 82 from being pushed in too far. The opening 77 and the inner passage 80 of the conduit 79 put the projectile holder 78 in fluid communication with the cylinder 24.

The projectile launch tube 18 further includes a seal protection rib 94, a sear engagement rib 96, a sear ramp 98, a spring compression rib 100, and a spring lip 102. Also, the seal 26 and the cocking handle 20 are fixed to the projectile launch tube 18. The seal 26 is fixed to the cylinder end 70 and has an outer diameter slightly larger than the diameter of the inner bore 68 for a snug but slidable fit between the seal 26 and the annular sidewall 60. The seal 26 abuts the seal protection rib 94 and defines an opening 104 so air flow to the inner passage 80 is not blocked. The cocking handle 20 is fixed to and surrounds the projectile launch tube 18 at or near the projectile end 72. The cocking handle 20 defines an opening 106 so the air being emitted from the inner passage 80 is not blocked. Also, the return spring 28 surrounds the projectile launch tube 18 and is disposed within the cylinder 24 between the return spring compression wall 40 and the spring compression rib 100.

The housing 12 further defines an oblong trigger opening 108 disposed near the handle 14. The trigger assembly 22 is disposed in the trigger opening 108. The trigger assembly 22 includes a trigger 110 and a trigger spring 114. The trigger 110 includes a finger pull 116 that is exposed through the opening 108 so that a user can pull the trigger 110 backwards, a ramp 118 for engaging the sear 30 located on a fore portion of the trigger 110, and a spring peg 120 located on a rear portion of the trigger 110. The trigger spring 114 is disposed over the spring peg 120 on one end, and abuts a stop 122 defined by the housing 12 on the other end. The trigger spring 114 is a compression spring (preferably made of music wire) and biases the trigger 110 forward.

As best seen in FIG. 4, the sear 30 includes a trigger actuated member 124, a retention tab 126, and a sear spring 128. The trigger actuated member 124 includes a trigger bearing surface 130 integrally formed with a horseshoe section 132 having a pair of sides 134 and a curved portion 136. Guide rail extensions 138 are also integrally formed with and extend downward from the horseshoe sides 134. The guide rail extensions 138 keep the sear 30 centered when the sear 30 is in an upward position. The retention tab 126 is integrally formed with and spans between the horseshoe sides 134. A peg 140 is also integrally formed with the retention tab 126 and extends upward therefrom. The sear spring 128 is positioned on the peg 140. The sear 30 is disposed around the cylinder 24 with the trigger bearing surface 130 disposed just above a base 141 of the trigger ramp 118 (FIG. 2). To slide the sear around the cylinder 24, the retention tab 126 is angled behind a cylinder lip 142 and placed into the receiving aperture 66 (FIG. 2). The curved portion 136 of the trigger actuated member 124 is then pushed underneath the cylinder 24. The sear sides 134 are then positioned in the space between the first and second retention ribs 44, 46 (FIG. 2) resting against a number of side spacers 144 (FIG. 4). The ribs 44, 46 and the spacers 144 keep the sear 30 from moving axially and laterally, respectively. The sear spring 128 is disposed within the spring chamber 56 in compression between the sear spring compression wall 54 (FIG. 2) and the retention tab 126, biasing the sear 30 downward.

The toy projectile launcher 10 has a forward cocked and a rearward uncocked position (FIGS. 2 and 3). The present invention, though, is not limited to only having these cocking orientations. Any cocking orientation that can be achieved by the disclosed invention is foreseeable. In this embodiment, a forward cocked position and a rearward uncocked position were chosen for their desirability (e.g., increased play value). By having a launch tube 18 which retracts from a forward position into the housing 12, the illusion is created that the stylized fictional creature is rearing backward and posturing to defend itself.

In the rearward uncocked position, the return spring 28 is not under load, the sear 30 is not engaging the launch tube 18, and the sear spring 128 is biasing the sear 30 downward. FIG. 2 illustrates the toy projectile launcher 10 in the forward cocked position. To cock the toy projectile launcher 10, a user grasps the cocking handle 20 in one hand and the handle 14 in the other, and pulls the cocking handle 20 outward. The cocking handle 20, in turn, pulls the launch tube 18. Continued outward pull of the cocking handle 20 causes the return spring 28 to ride up the spring lip 102 and be compressed between the spring compression rib 100 and the return spring compression wall 40. At approximately the same time, the sear ramp 98 is making contact with the sear retention tab 126, pushing the sear retention tab 126 upward. Once the sear engagement rib 96 is pulled past the retention tab 126, the sear spring 128, which is now under load, pushes the retention tab 126 downward back into the sear receiving aperture 66 and into engagement with the sear engagement rib 96 keeping the launch tube 18 maintained in a forward cocked position against the force of the return spring 28. The seal protection rib 94 keeps the user from pulling the launch tube 18 too far out which might cause the retention tab 126 to rip the seal 26. The dart 82 may be inserted into the projectile holder 78 either now or before cocking. It is immaterial to the cocking operation when the dart 82 is inserted into the toy projectile launcher 10.

To launch the dart 82 (FIG. 3), the user pulls the trigger 110. As the user pulls back on the finger pull 116, the trigger bearing surface 130 rides up the ramp 118. The trigger bearing surface 130, in turn, pushes the retention tab 126 upward. Once the retention tab 126 is pushed higher than the sear engagement rib 96, the launch tube 18 releases, and the return spring 28 pushes the launch tube 18 backward. As the launch tube 18 moves backward, air is compressed between the seal 26 and the cylinder back wall 62. The compressed air is pushed through the launch tube inner passage 80 and the opening 77 into the dart inner chamber 83. Pressure builds up in the dart inner chamber 83 until the force exerted on the dart 82 exceeds the frictional force created by the interference fit between the dart shaft 88 and the dart fit chamber 86. At that point, the dart shaft 88 separates from the dart fit chamber 86, sending the dart 82 flying forward out of the launch tube 18 (FIG. 3). The launch tube 18 may be provided with one or more side ports to attenuate some of the force of the compressed air to keep the velocities of launched projectiles within safe limits. The launch tube 18 continues its rearward movement until the return spring 28 has released all of its stored energy.

Once the dart 82 is launched, the user may release the trigger 110. The trigger spring 114 biases the trigger 110 back toward a forward position (FIG. 2). The toy projectile launcher 10 is now back in the previously described rearward uncocked position, and is ready to be cocked and fired again.

Referring now to FIG. 2., the toy projectile launcher 10 also includes a power source 184, a light bulb 166, a pair of light bulbs 176, a fixed contact 186, and a movable contact 112 which define a circuit when the movable contact 112 is in a closed position and cause the light bulbs 166, 176 to illuminate.

The power source 184 is batteries in the preferred embodiment and is located in a power compartment 182 defined by the handle 14. The upper portion of the power compartment 182 is defined by the fixed contact 186 which is fixed to the right half 12A of the housing 12. The lower portion of the power compartment 182 is defined by a door 188 which includes an electrical contact 190. The door 188 is held closed by a screw 189 and is rotatable about a pivot arm 191 when the door 188 is opened. The door 188 provides the user with access to the power compartment 182 so the batteries can be changed when needed.

The movable contact 112 is fixed to trigger 110 below the spring peg 120 and is disposed forward of the fixed contact 186 when the trigger 110 is not engaged to define an open position.

The toy projectile launcher 10 further includes an adjuster lens 32. The adjuster lens 32 is disposed in an upper front portion of the housing 12 behind a pair of openings 145, 147 formed in the housing 12 (FIG. 2). As best illustrated in FIG. 4, the adjuster lens 32 includes a focuser 146 and a bracket 148. The focuser 146 includes a pair of adjustment handles 150, a lens 152, and a plurality of upper and lower lateral adjustment teeth 154. The bracket 148 includes a plurality of upper and lower lateral adjustment teeth 156 and a plurality of side vertical adjustment teeth 158. The focuser 146 is disposed within the bracket 148 so that the focuser lateral adjustment teeth 154 engage the bracket lateral adjustment teeth 156. The focuser 146 and the bracket 148 are disposed in the housing 12 such that the pair of adjustment handles 150 extend through a pair of openings 160 in the housing 12, and the bracket vertical adjustment teeth 158 engage similar vertical adjustment teeth 162 formed in the housing 12.

The light bulb 166 is disposed in an adjuster lens illumination assembly 34 (FIG. 2). The adjuster lens illumination assembly 34 is disposed directly rearward of the adjuster lens 32 in the housing 12. The adjuster lens illumination assembly 34 includes a support 164 and an electrical contact 168. The support 164 is disposed in a recess 170 formed in the housing 12, and the light bulb 166 extends through the support 164. The bottom sides of the light bulb 166 make contact with the electrical contact 168, and the tip of the light bulb 166 makes contact with an electrical contact 172 fixed to the housing 12. The light bulb 166 is positioned underneath a door 174 formed in the housing 12. The door 174 can be opened by a user, and provides the user access to the illumination assembly 34 so that the light bulb 166 can be replaced when needed.

The light bulbs 176 are disposed in an opening illumination assembly 36. The opening illumination assembly 36 is disposed forward of and above the cylinder 24. The opening illumination assembly 36 is positioned in a pair of openings 180 (FIG. 1) in the housing 12 such that one light bulb 176 is disposed in one opening 180. The openings 180 may be formed in any shape, but they are preferably shaped to resemble eyes. A series of wires 192 connects the movable contact 112, the electrical contact 172, the light bulbs 176, the electrical contact 168, and the fixed contact 186 to each other.

The pull of the trigger 110 acts to illuminate the light bulbs 166, 176 as well as to launch the dart 82. As described above, the movable contact 112 is in the open position when the trigger 110 is at rest. When the trigger 110 is pulled rearward, the movable contact 112 comes into contact with the fixed contact 186 to define a closed position. This happens before the launch tube 18 is released from the cocked position. In the closed position, the circuit between the power source 184 and the light bulbs 166, 176 is complete. Consequently, the light bulbs 166, 176 illuminate. The light bulbs 176 illuminate through the openings 180, giving the illusion that the toy projectile launcher 10 has eyes. The light bulb 166 radiates through the lens 152 of the focuser 146 and through the openings 145, 147 to illuminate a point on a distant surface, giving the illusion that the toy projectile launcher 10 has a laser sighting device.

As described above, once the user releases the trigger 110, the trigger spring 114 biases the trigger 110 back toward the forward position. As the trigger 110 moves forward, the movable contact 112 disengages from the fixed contact 186, and as such, the light bulbs 166, 176 turn off. The movable contact 112 comes to rest in the open position (FIG. 2).

If after the first launch, the dart 82 did not hit where the light from the adjuster lens 32 was focused, the user can then align the adjuster lens 32 with the point of impact of the dart 82 up to a certain distance. To do this, the user sights a point with the adjuster lens 32 and shoots a dart 82 at the sighted point. If the dart 82 hits the illuminated point, then the adjuster lens 32 and the projectile launch tube 18 are aligned. If the dart 82 misses, then the adjuster lens 32 and the projectile launch tube 18 are out of alignment. To realign the adjuster lens 32 and the projectile launch tube 18, the user grasps the adjustment handles 150. To adjust vertically, the user pulls up or pushes down on the handles 150, causing the bracket vertical adjustment teeth 158 to move along the housing vertical adjustment teeth 162. To adjust laterally, the user pushes or pulls the adjustment handles 150 left or right, causing the focuser lateral adjustment teeth 154 to move along the bracket lateral adjustment teeth 156. The user continues to adjust the adjuster lens 32 in this manner until the point illuminated by the adjuster lens 32 aligns with the point where the dart 82 hits (e.g. the adjuster lens 32 and the projectile launch tube 18 are zeroed).

The foregoing is provided for clearness of understanding only and no unnecessary limitations therefrom should be read into the following claims.

We claim:

1. A toy projectile launcher, comprising:

a housing;

a cylinder fixed to the housing and defining an inner bore;

a projectile launch tube slidably disposed in the cylinder for movement from a cocked position to an uncocked position to compress gas in the cylinder, and including a projectile holder in fluid communication with the cylinder to releasably mount a projectile to be launched;

a seal fixed to the projectile launch tube and in sealing engagement with the cylinder inner bore;

a sear for releasably maintaining the projectile launch tube in the cocked position;

biasing means for returning the projectile launch tube to the uncocked position; and a trigger for engaging the sear to release the projectile launch tube from the cocked position and emit compressed gas to the projectile holder.

2. The toy projectile launcher of claim 1 in which the biasing means is a spring.

3. The toy projectile launcher of claim 1 in which the projectile holder defines a chamber for receiving therein a projectile.

4. The toy projectile launcher of claim 1 in which the projectile holder is adapted to receive a projectile made of a soft material.

5. The toy projectile launcher of claim 1, and further comprising a cocking handle fixed to the projectile launch tube.

6. The toy projectile launcher of claim 1 wherein:

the cocked position is a forward position; and the uncocked position is a rearward position.

7. The toy projectile launcher of claim 1 in which:

the projectile launch tube further comprises an integrally formed sear engagement rib; and the sear comprises a trigger actuated bearing surface, a retention tab for releasably engaging the sear engagement rib, and a spring for biasing the retention tab into releasable engagement with the projectile launch tube sear engagement rib.

8. The toy projectile launcher of claim 7 in which the trigger has a ramp for slidably engaging the trigger actuated bearing surface to move the sear out of engagement with the sear engagement rib when the trigger is pulled.

9. The toy projectile launcher of claim 7 in which the cylinder defines an aperture into which the sear extends to engage the launch tube engagement rib in the cocked position.

10. The toy projectile launcher of claim 1, and further comprising:

a power source;

a light bulb in electrical communication with the power source;

a fixed contact attached to the housing and in electrical communication with the light and the power source; and a movable contact fixed to the trigger and in electrical communication with the power source, and movable from an open position to a closed position in electrical communication with the fixed contact to define a circuit between the power source and the light bulb and cause the light bulb to illuminate.

11. The toy projectile launcher of claim 10, and further comprising an adjuster lens joined to the housing and disposed such that light from the light bulb radiates through the adjuster lens when the movable contact is in the closed position.

12. The toy projectile launcher of claim 10 wherein the movable contact in the open position is spaced apart from the fixed contact, such that the movable contact moves to the closed position before the trigger engages the sear to release the projectile launch tube from the cocked position.

13. The toy projectile launcher of claim 10, and further comprising:

a pair of light bulbs disposed in the housing and in electrical communication with the power source; and a pair of openings in the housing, such that each light bulb radiates light through at least one of the openings when the movable contact is in the closed position.

14. A toy projectile launcher, comprising:

a housing;

a cylinder fixed to the housing and defining an inner bore;

a projectile launch tube slidably disposed in the cylinder for movement from a cocked position to an uncocked position to compress gas in the cylinder, and including a projectile holder in fluid communication with the cylinder to releasably mount a projectile to be launched;

a seal fixed to the projectile launch tube and in sealing engagement with the cylinder inner bore;

a sear for releasably maintaining the projectile launch tube in the cocked position;

a spring for returning the projectile launch tube to the uncocked position;

a trigger for engaging the sear to release the projectile launch tube from the cocked position and emit compressed gas to the projectile holder;

a power source;

a light bulb in electrical communication with the power source;

a fixed contact attached to the housing and in electrical communication with the light and the power source; and a movable contact fixed to the trigger and in electrical communication with the power source, and movable from an open position to a closed position in electrical communication with the fixed contact to define a circuit between the power source and the light bulb and cause the light bulb to illuminate.

15. The toy projectile launcher of claim 14 in which the projectile launch tube is in fluid communication with the cylinder via a conduit.

16. The toy projectile launcher of claim 14 in which the projectile holder defines a chamber for receiving therein a projectile.

17. The toy projectile launcher of claim 14 in which the projectile holder is adapted to receive a projectile made of a soft material.

18. The toy projectile launcher of claim 14, and further comprising a cocking handle fixed to the projectile launch tube.

19. The toy projectile launcher of claim 14 wherein:

the cocked position is a forward position; and the uncocked position is a rearward position.

20. The toy projectile launcher of claim 14 in which:

the projectile launch tube further comprises an integrally formed sear engagement rib; and the sear comprises a trigger actuated bearing surface, a retention tab for releasably engaging the sear engagement rib, and a spring for biasing the retention tab into releasable engagement with the projectile launch tube sear engagement rib.

21. The toy projectile launcher of claim 20 in which the trigger has a ramp for slidably engaging the trigger actuated bearing surface to move the sear out of engagement with the sear engagement rib when the trigger is pulled.

22. The toy projectile launcher of claim 20 in which the cylinder defines an aperture into which the sear extends to engage the launch tube engagement rib in the cocked position.

23. The toy projectile launcher of claim 14, and further comprising an adjuster lens joined to the housing and disposed such that light from the light bulb radiates through the adjuster lens when the movable contact is in the closed position.

24. The toy projectile launcher of claim 14 wherein the movable contact in the open position is spaced apart from the fixed contact, such that the movable contact moves to the closed position before the trigger engages the sear to release the projectile launch tube from the cocked position.

25. The toy projectile launcher of claim 14, and further comprising:

a pair of light bulbs disposed in the housing and in electrical communication with the power source; and a pair of openings in the housing, such that each light bulb radiates light through at least one of the openings when the movable contact is in the closed position.

* * * * *